US008790438B2

(12) United States Patent
Millar et al.

(10) Patent No.: US 8,790,438 B2
(45) Date of Patent: Jul. 29, 2014

(54) COLORED METAL

(75) Inventors: Caroline Elizabeth Millar, Surrey (GB); Stuart Paul Godfrey, Hants (GB)

(73) Assignee: Nokia Corporation, Espoo (FI)

( * ) Notice: Subject to any disclaimer, the term of this patent is extended or adjusted under 35 U.S.C. 154(b) by 729 days.

(21) Appl. No.: 12/648,390

(22) Filed: Dec. 29, 2009

(65) Prior Publication Data

US 2011/0159216 A1 Jun. 30, 2011

(51) Int. Cl.

| | |
|---|---|
| ***B22F 3/10*** | (2006.01) |
| ***B22F 3/24*** | (2006.01) |
| ***C22C 1/05*** | (2006.01) |

(52) U.S. Cl.

USPC ..... 75/230; 75/232; 75/234; 75/235; 75/243; 75/246; 75/249; 419/11; 419/19; 419/23; 419/28; 419/30; 419/48

(58) Field of Classification Search

USPC ..... 75/230, 232, 234, 235, 243, 246, 249; 419/11, 19, 48

See application file for complete search history.

(56) References Cited

U.S. PATENT DOCUMENTS

| | | | | | |
|---|---|---|---|---|---|
| 3,165,821 | A | * | 1/1965 | Breton | 419/10 |
| 3,173,785 | A | * | 3/1965 | Manganello | 419/10 |
| 3,282,658 | A | * | 11/1966 | Wainer | 428/293.1 |
| 3,428,440 | A | * | 2/1969 | Roth | 75/233 |
| 3,901,717 | A | * | 8/1975 | Revaz | 75/235 |
| 4,863,514 | A | * | 9/1989 | Groll et al. | 75/235 |
| 5,045,972 | A | * | 9/1991 | Supan et al. | 361/706 |
| 6,572,670 | B1 | * | 6/2003 | Theide et al. | 75/235 |

FOREIGN PATENT DOCUMENTS

| | | | | |
|---|---|---|---|---|
| EP | 0 465 101 | A1 | | 1/1992 |
| EP | 1 394 293 | A1 | | 3/2004 |
| JP | 50028411 | A | | 3/1975 |
| JP | 50150608 | A | | 12/1975 |
| JP | 54 089999 | A | | 7/1979 |
| JP | 55002788 | A | | 1/1980 |
| JP | 59136447 | | * | 8/1984 |
| JP | S62 222041 | A | | 9/1987 |
| JP | H03 28348 | A | | 2/1991 |
| JP | 6172889 | A | | 6/1994 |
| KR | 20090066704 | A | | 6/2009 |
| WO | WO 92/03585 | A1 | | 3/1992 |

OTHER PUBLICATIONS

R. Pavlov et al., "Electronic Absorption Spectroscopy and Colour of Chromium-Doped Solids", Journal of Materials Chemistry, vol. 12, pp. 2825-2832, Jul. 30, 2002.

* cited by examiner

*Primary Examiner* — George Wyszomierski
*Assistant Examiner* — Ngoclan T Mai
(74) *Attorney, Agent, or Firm* — Harrington & Smith

(57) ABSTRACT

A colored metal composite including a metal matrix; and colored particles distributed throughout the metal matrix AND/OR a method including providing metal powder as a first phase of a composite; providing colored particles to form a second phase of the composite; mixing the metal powder and colored particles; and sintering the metal powder around the colored particles to form a metal matrix that has colored particles distributed throughout.

61 Claims, 2 Drawing Sheets

COLORED METAL

FIELD OF THE INVENTION

Embodiments of the present invention relate to colored metal. In particular, they relate to a metal composite that is colored throughout.

BACKGROUND TO THE INVENTION

At present color is applied to metal in an unsatisfactory manner.

The color is typically applied by anodizing, plating or adding an outer coating of paint or adding a physical vapor deposition (PVD) layer. These colorations are susceptible to wear with subsequent loss of coloration where, for example, the outer coloration is lost or damaged.

BRIEF DESCRIPTION OF VARIOUS EMBODIMENTS OF THE INVENTION

The inventors have been able to successfully integrate colored particles within a metal matrix to form a colored metal composite.

According to various, but not necessarily all, embodiments of the invention there is provided a colored metal composite comprising: a metal matrix; and colored particles distributed throughout the metal matrix.

According to various, but not necessarily all, embodiments of the invention there is provided a method comprising: providing metal powder as a first phase of a composite; providing colored particles to form a second phase of the composite; mixing the metal powder and colored particles; and sintering the metal powder around the colored particles to form a metal matrix that has colored particles distributed throughout.

According to various, but not necessarily all, embodiments of the invention there is provided a colored part made from colored metal that is colored throughout wherein the colored metal forms a presentation surface of the colored part and wherein removal of a portion of the presentation surface of the colored part reveals colored metal.

According to various, but not necessarily all, embodiments of the invention there is provided a method comprising: creating colored metal that is colored throughout; and working the colored metal.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
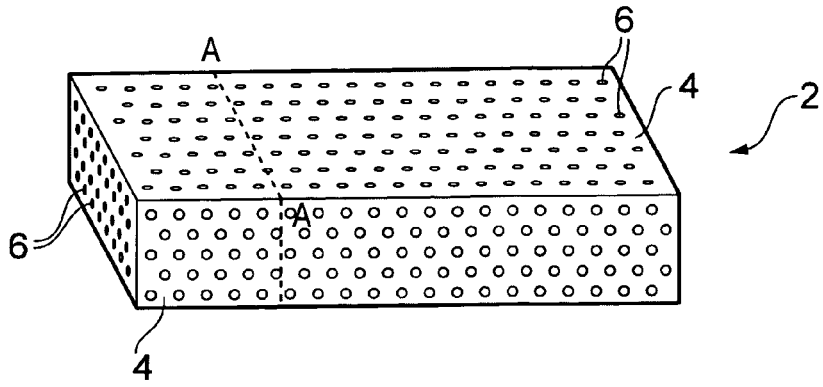
FIG. 1 schematically illustrates a block of colored metal composite.

FIG. 1 schematically illustrates a colored metal composite 2 comprising: a metal matrix 4; and colored particles 6 distributed throughout the metal matrix 4.

In this example, the metal matrix 4 is a sintered metal matrix formed by sintering metal powder. The metal matrix 4 may, for example, be formed from any suitable metal. One suitable class of metals is engineering metals such as aluminum, steel, or titanium. Another suitable class of metals is precious metals such as gold and silver.

The concentration of colored particles 6 in the metal matrix 4 may be any suitable concentration and a suitable concentration can be experimentally determined. A suitable concentration may lie within the range 25 to 50% by volume or may lie outside that range. The colored particles may be evenly distributed throughout the metal matrix 4. The colored particles will then have a surface density at any surface of the colored metal composite 2 that is consistent. The surface density at the surface may be any suitable density and a suitable density can be experimentally determined. A suitable density may lie within the range 25 to 50% colored particles by surface area or outside that range. A suitable density may be one that is sufficient to give the colored metal composite a consistent hue to the human eye.

Figure 2:
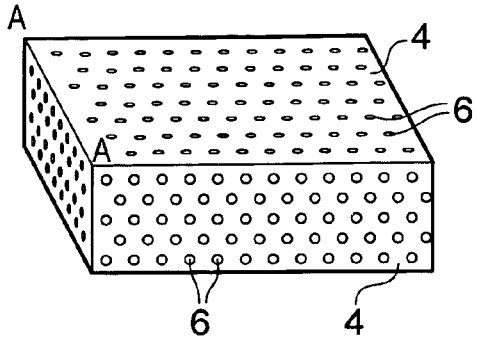
FIG. 2 schematically illustrates a cross-sectional view of the block of colored metal composite.

FIG. 2 schematically illustrates a cross-sectional view of the block of colored metal composite 2 illustrated in FIG. 1 when it is sectioned along the line A-A. FIG. 2 schematically illustrates the even distribution of colored particles throughout the metal composite 2.

The colored particles 6 may have a size between 1 μm and 100 μm. The colored particles 6 may be discrete individual particles in the metal matrix 4.

The colored particles 6 are inert at the sintering point of the metal matrix 4 and, in this example, have a melting point that is higher than the sintering point of the metal matrix.

This requirement for inertness and stability at high temperature means that ionic compounds particularly oxides are good candidates for use as the colored particles as are minerals particularly metamorphic minerals and gemstones. Some covalent compounds or elements may also be good candidates, such as diamond.

The colored particles may be inherently colored as opposed to pigmented by a separate phase. In this case, a base material may incorporate structural modifications. The structural modifications are modifications to the structure of the base material e.g. an impurity or dopant replaces an atom of the structure of the base material, or an atom of the structure of the base material is missing at a defect. The base material may be clear (transparent) without structural modifications but strongly colored with structural modifications.

In some embodiments, the base material of a particle is a single crystal and the structural modifications may be dopants integrated within the crystal lattice, naturally occurring impurities integrated within the crystal lattice or defects in the crystal lattice. For synthetic single crystals, the color of the particle is controlled by the choice of base material and dopant or defect.

In some embodiments, the base material of a particle is a non-crystalline (e.g. amorphous) or polycrystalline transparent material such as glass, glass-ceramics, fused silica, transparent ceramics. The structural modifications are dopants integrated as part of the base material's structure The colored particles 6 in the metal matrix 4 may comprise only a single type of base material rather than a mixture of different types of base material. However, in some applications, a mixture of different types of colored particles 6 may be integrated within the metal matrix 4.

Suitable single crystal types include, for example, any of: sapphire ($Al_2O_3$ corundum), cubic zirconia ($ZrO_2$), YAG (yttrium aluminium garnet, $Y_3Al_5O_{12}$), spinel ($AlMg_2O_4$), and diamond.

The single crystals used as the colored particles 6 may be synthetic crystals and/or they may be natural crystals. Natural crystals are colored by naturally occurring impurities (dopants) in the crystal.

The single crystals used as the colored particles 6 may be allochromatic. Allochromatism is the coloration caused by the presence of a trace element or impurity that is foreign to a crystal lattice. Allochromatic coloration may, for example, be caused by electrons from "transition metal" trace impurities (dopants) found within crystalline structures. In synthetic crystals, the trace impurities may be deliberately added to the crystal lattice as dopants where they become integrated within the crystal lattice of the single crystals. The single crystals may be clear (transparent) when undoped but strongly colored when doped. Suitable transition metal dopants include any of: chrome, titanium, iron, neodymium, erbium, nickel, cobalt, copper, vanadium.

The single crystals used as the colored particles 6 may be idiochromatic. Idiochromatism occurs when the presence of essential or major constituents within the mineral's crystal lattice determine which wavelengths of light are reflected and which are absorbed, determining color.

A particular color may be achieved by using colored particles 6 that are formed from the correct combination of single crystal and dopant and/or single crystal and defect.

The table below indicates what colors are achievable for different combinations of single crystal and dopant and for different combinations of single crystal and defect. The single crystals include cubic zirconia, sapphire, spinel, YAG and diamond. The table is intended to be representative, not exhaustive.

| | Cubic Zirconia | Sapphire | Spinel | YAG | Diamond |
|---|---|---|---|---|---|
| Pink | Erbium, Europium, Holmium | Chrome | Chrome or Iron | Manganese | Imperfect carbon structure |
| Red | Erbium | Chrome | Chrome or Iron | Manganese | |
| Orange | Cerium | | | | |
| Yellow | Cerium | Iron | Iron | Titanium | Nitrogen irradiation |
| Green | Chrome, Thulium, Vanadium | Iron | | Chrome | |
| Blue | Cerium, Yttrium | Both Iron and Titanium | Cobalt | Cobalt | Boron |
| Violet | Cobalt or Manganese or Neodymium | Zanadium | Cobalt | Neodymium | |
| Brown | Iron or titanium | Iron | Iron | | Nitrogen |
| Grey | | | | | Boron |
| Black | Chrome | Chrome | Chrome | | Inclusions of Non-diamond carbon |

A particular color may be achieved by using colored particles 6 that are formed from the correct combination of single crystal and defect. For example, an imperfect carbon lattice may be colored pink, purple or yellow. The imperfect carbon lattice can be formed by introducing defects into diamond using heat treatment and/or irradiation.

Although specific examples of particles comprising combinations of base material and structural modifications have been described, further new combinations are expected to be systematically developed. Suitable constraint for defining a reduced 'search space' in which suitable colored particles are identifiable include: the colored particles 6 are inert at the appropriate processing temperature of the colored metal e.g. at the sintering point of the metal matrix 4.

An additional constraint may be that the colored particles 6 have a melting point that is higher than the processing temperature.

Figure 3:
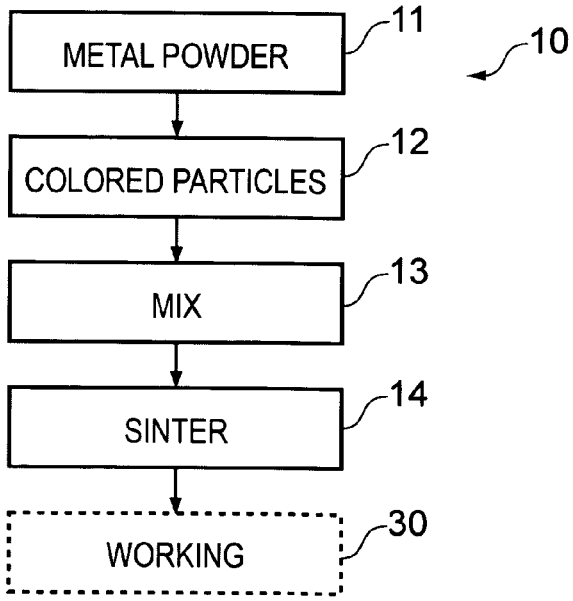
FIG. 3 schematically illustrates a method of manufacturing the colored metal composite.

An additional constraint may be that the colored particles are inherently colored by structural modifications within the structure of a base material FIG. 3 schematically illustrates a method of forming a metal matrix 4 that has colored particles 6 distributed throughout, such as the colored metal composite 2 illustrated in FIGS. 1 and 2.

The method 10 comprises:

at block 11 metal powder is provided as a first phase of a composite;

at block 12 colored particles 6 are provided as a second phase of the composite;

at block 13 the composite metal powder and colored particles are mixed;

at block 14 the metal powder is sintered around the colored particles to form a metal matrix 4 that has colored particles 6 distributed throughout.

The sintering is solid state sintering which joins or coalesces the metal powder without melting the metal. The sintering point varies from metal to metal. For aluminum it may be between 500-550° C. For steel it may be between 1200-1300° C. For titanium it may be between 900-1200° C.

In one embodiment, the metal powder and colored particles may be mixed in a crucible or furnace. During sintering, heat is applied to the mixture of the metal powder and colored particles. Pressure may also be applied to aid the sintering process.

In another embodiment, metal powder from one feed and colored particles from another feed are evenly distributed in a mixture and then laser sintered or electron beam sintered.

Although sintering of the metal powder is preferred, in may be possible to also partially or fully melt the metal and also achieve a colored metal composite, In this example, the colored particles 6 should be inert at the maximum temperature used. The colored particles may also have a melting point that is higher than the maximum temperature used.

Figure 4A:
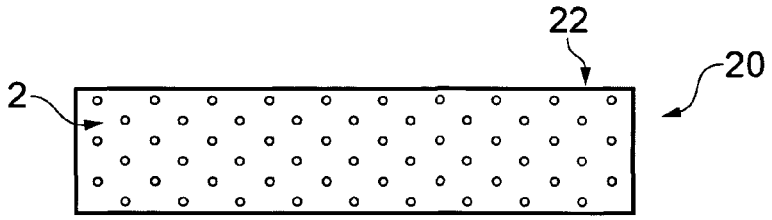
FIGS. 4A and 4B schematically illustrate an example of an application of the colored metal composite.
Figure 4B:
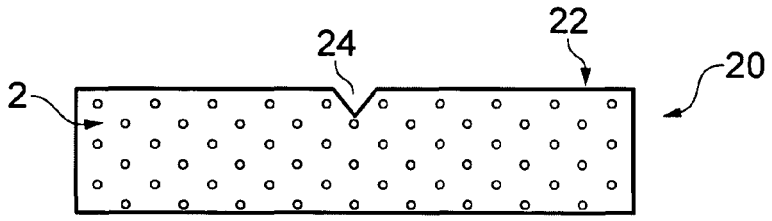

FIGS. 4A and 4B schematically illustrate an application of the colored metal composite 2. In FIG. 4A, a colored part 20 made from colored metal 4 that is colored throughout using colored particles 6. The colored metal 4 forms a presentation surface 22 of the colored part 20. In FIG. 4B, removal of a portion 24 of the presentation surface 22 of the colored part reveals colored metal 4.

It should be noted that the colored particles 6 are evenly distributed throughout the colored metal composite 2 include the interior of the colored metal composite.

The removal of a portion 24 of the presentation surface 22 of the colored part 20 reveals colored metal 4 irrespective of the size of the portion removed. A scratch through the presentation surface 22 is substantially inconspicuous as a result of the presence of the colored metal throughout the colored exterior body. Once scratched, the presentation surface 20 can be easily repaired by re-polishing.

The colored part 20 is suitable for use as a body part for a vehicle such as a car. The colored part 20 may also be suitable for use as a body part for metal items that are subject to wear by contact such as latches, utensils, etc.

The colored part 20 is suitable for use as a cover or housing. It may therefore find application as a cover for an electronic device such as a laptop, a mobile cellular telephone, a personal music player, a personal digital assistant, a e-book reader, a television set, a console etc.

Referring back to FIG. 3, an additional block 30 may be added after the method 10 creating colored metal that is colored throughout has completed at block 14. At this additional block 30 the colored metal is physically worked. This may involve machining, slicing, forging, stamping etc. As the colored metal is colored throughout physically working the metal does not affect its coloration.

The blocks illustrated in the Figs may represent steps in a method. The illustration of a particular order to the steps does not necessarily imply that there is a required or preferred order for the steps and the order and arrangement of the steps may be varied. Furthermore, it may be possible for some steps to be omitted or added.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A colored metal composite comprising:

a metal matrix; and colored particles distributed throughout the metal matrix, wherein the colored particles are allochromatic and comprise an ionic compound, the metal matrix comprises an engineering metal and the colored metal composite has a surface and the colored particles have a surface density at the surface that is sufficient to give the colored metal composite a consistent hue to the human eye.

2. A colored metal composite as claimed in claim 1, wherein the colored particles are inherently colored by structural modification of a base material.

3. A colored metal composite as claimed in claim 1, wherein the colored particles are single crystals.

4. A colored metal composite as claimed in claim 3, wherein the single crystals are selected from the group consisting of corundum, Cubic zirconia, yttrium aluminium garnet, and spinel.

5. A colored metal composite as claimed in claim 3, wherein the single crystals are synthetic crystals.

6. A colored metal composite as claimed in claim 3, wherein the single crystals are natural crystals.

7. A colored metal composite as claimed in claim 1, wherein the colored particles are inherently colored by the integration of dopant within a base material of the colored particles.

8. A colored metal composite as claimed in claim 7, wherein a base material of the colored particles when undoped is transparent.

9. A colored metal composite as claimed in claim 7, wherein the dopant is a transition metal dopant.

10. A colored metal composite as claimed in claim 9, wherein the transition metal dopant is selected from the group consisting of Chrome, titanium, iron, neodymium, erbium, nickel, cobalt, copper, vanadium.

11. A colored metal composite as claimed in claim 1, wherein the metal matrix is a sintered metal matrix.

12. A colored metal composite as claimed in claim 1, wherein the metal matrix comprises a metal selected from the group consisting of steel and titanium.

13. A colored metal composite as claimed in claim 1, wherein the colored particles are evenly distributed throughout a volume shared with the metal matrix.

14. A colored metal composite as claimed in claim 1, wherein the colored particles have a substantially consistent surface density at the surface that is between 25 and 50% by surface area.

15. A colored metal composite as claimed in claim 1, wherein the colored metal composite has a concentration of colored particles between 25 and 50% by volume.

16. A colored metal composite as claimed in claim 1, wherein the colored particles have a size between 1 and 100 μm.

17. A colored metal composite as claimed in claim 1, wherein the colored particles are inert at the sintering point of the metal matrix.

18. A colored metal composite as claimed in claim 1, wherein the colored particles have a melting point that is higher than the sintering point of the metal matrix.

19. A colored metal composite as claimed in claim 1, wherein the colored particles are discrete particles in the metal matrix.

20. A colored metal composite as claimed in claim 1, wherein the colored particles are non-crystalline.

21. A colored metal composite as claimed in claim 1, wherein the colored particles comprise an oxide.

22. A colored metal composite as claimed in claim 1, wherein the colored particles are a mineral, metamorphic mineral or gemstone.

23. A method comprising:

providing metal powder as a first phase of a composite;

providing colored particles to form a second phase of the composite;

mixing the metal powder and colored particles; and sintering the metal powder around the colored particles to form a colored metal composite comprising a metal matrix that has colored particles distributed throughout, wherein the colored particles are allochromatic, the metal matrix comprises an engineering metal and the colored metal composite has a surface and the colored particles have a surface density at the surface that is sufficient to give the colored metal composite a consistent hue to the human eye.

24. A method as claimed in claim 23, wherein the sintering is solid state sintering.

25. A method as claimed in claim 23, wherein during sintering, pressure and heat are applied to the mixture of the metal powder and colored particles.

26. A method as claimed in claim 23, wherein the metal matrix comprises a metal selected from the group consisting of steel and titanium.

27. A method as claimed in claim 23, wherein the colored metal composite has a concentration of colored particles between 25 and 50% by volume.

28. A method as claimed in claim 23, wherein the colored particles have a size between 1 and 100 μm.

29. A method as claimed in claim 23, wherein the colored particles are inert at the sintering point of the metal powder.

30. A method as claimed in claim 23, wherein the colored particles have a melting point that is higher than the sintering point of the metal powder.

31. A method as claimed in claim 23, wherein the colored particles are inherently colored.

32. A method as claimed in claim 23, wherein the colored particles are single crystals.

33. A method as claimed in claim 32, wherein the single crystals are selected from the group consisting of corundum, Cubic zirconia, Yttrium aluminium garnet, spinel, and diamond.

34. A method as claimed in claim 32, wherein the single crystals are synthetic crystals.

35. A method as claimed in claim 23, wherein the colored particles comprise a transition metal dopant.

36. A method as claimed in claim 35, wherein the transition metal dopant is selected from the group consisting of Chrome, titanium, iron, neodymium, erbium, nickel, cobalt, copper, vanadium.

37. A method as claimed in claim 23, wherein the colored particles comprise an oxide.

38. A colored part made from colored metal that is colored throughout using colored particles, wherein: the colored metal forms a presentation surface of the colored part, removal of a portion of the presentation surface of the colored part reveals colored metal, the colored particles are allochromatic and comprise an ionic compound, the colored metal comprises an engineering metal and the colored particles have a surface density at the presentation surface that is sufficient to give the colored metal a consistent hue to the human eye.

39. A colored part as claimed in claim 38, wherein removal of a portion of the presentation surface of the colored part reveals colored metal irrespective of the size of the portion removed.

40. A colored part as claimed in claim 38, wherein a scratch through the presentation surface is substantially inconspicuous as a result of the presence of the colored metal throughout the colored exterior body.

41. A colored part as claimed in claim 38, forming a body part for a vehicle.

42. A colored part as claimed in claim 38, forming a cover or housing.

43. A method comprising:

creating colored metal that is colored throughout using colored particles; and working the colored metal, wherein the colored particles are allochromatic and comprise an ionic compound, the colored metal comprises an engineering metal and the colored metal has a surface and the colored particles have a surface density at the surface that is sufficient to give the colored metal a consistent hue to the human eye.

44. A method as claimed in claim 43, wherein working comprises one or more of machining, slicing, forging, stamping.

45. A method as claimed in claim 43, wherein creating the colored metal comprises a method providing metal powder as a first phase of a composite;

providing colored particles to form a second phase of the composite;

mixing the metal powder and colored particles; and sintering the metal powder around the colored particles to form a metal matrix that has colored particles distributed throughout.

46. A colored metal composite comprising:

a metal matrix; and colored particles distributed throughout the metal matrix, wherein the colored particles comprise an ionic compound and the colored particles are inherently colored by the integration of dopant within a base material of the colored particles, the metal matrix comprises an engineering metal and the colored metal composite has a surface and the colored particles have a surface density at the surface that is sufficient to give the colored metal composite a consistent hue to the human eye.

47. A colored metal composite as claimed in claim 46, wherein a base material of the colored particles when undoped is transparent.

48. A method comprising:

providing metal powder as a first phase of a composite;

providing colored particles to form a second phase of the composite;

mixing the metal powder and colored particles; and sintering the metal powder around the colored particles to form a colored metal composite comprising a metal matrix that has colored particles distributed throughout, wherein the colored particles are inherently colored by the integration of dopant within a base material of the colored particles, the metal matrix comprises an engineering metal and the colored metal composite has a surface and the colored particles have a surface density at the surface that is sufficient to give the colored metal composite a consistent hue to the human eye.

49. A method as claimed in claim 48, wherein a base material of the colored particles when undoped is transparent.

50. A colored part made from colored metal that is colored throughout using colored particles, wherein: the colored metal forms a presentation surface of the colored part, removal of a portion of the presentation surface of the colored part reveals colored metal, the colored particles comprise an ionic compound and the colored particles are inherently colored by the integration of dopant within a base material of the colored particles, the colored metal comprises an engineering metal and the colored particles have a surface density at the presentation surface that is sufficient to give the colored metal a consistent hue to the human eye.

51. A colored part as claimed in claim 50, wherein a base material of the colored particles when undoped is transparent.

52. A method comprising:

creating colored metal that is colored throughout using colored particles; and working the colored metal, wherein the colored particles comprise an ionic compound and the colored particles are inherently colored by the integration of dopant within a base material of the colored particles, the colored metal comprises an engineering metal and the colored metal has a surface and the colored particles have a surface density at the surface that is sufficient to give the colored metal a consistent hue to the human eye.

53. A method as claimed in claim 52, wherein a base material of the colored particles when undoped is transparent.

54. A colored metal composite comprising:

a metal matrix; and colored particles distributed throughout the metal matrix, wherein the colored particles are a mineral, metamorphic mineral or gemstone and the colored particles comprise an ionic compound, the metal matrix comprises an engineering metal and the colored metal composite has a surface and the colored particles have a surface density at the surface that is sufficient to give the colored metal composite a consistent hue to the human eye.

55. A colored metal composite as claimed in claim 54, wherein the colored particles have a size between 1 and 100 μm.

56. A method comprising:

providing metal powder as a first phase of a composite;

providing colored particles to form a second phase of the composite;

mixing the metal powder and colored particles; and sintering the metal powder around the colored particles to forma colored metal composite comprising a metal matrix that has colored particles distributed throughout, wherein the colored particles are a mineral, metamorphic mineral or gemstone, the metal matrix comprises an engineering metal and the colored metal composite has a surface and the colored particles have a surface density at the surface that is sufficient to give the colored metal composite a consistent hue to the human eye.

57. A method as claimed in claim 56, wherein the colored particles have a size between 1 and 100 μm.

58. A colored part made from colored metal that is colored throughout using colored particles, wherein: the colored metal forms a presentation surface of the colored part, removal of a portion of the presentation surface of the colored part reveals colored metal, the colored particles are a mineral, metamorphic mineral or gemstone and the colored particles comprise an ionic compound, the colored metal comprises an engineering metal and the colored particles have a surface density at the presentation surface that is sufficient to give the colored metal a consistent hue to the human eye.

59. A colored part as claimed in claim 58, wherein the colored particles have a size between 1 and 100 μm.

60. A method comprising:

creating colored metal that is colored throughout using colored particles; and working the colored metal, wherein the colored particles are a mineral, metamorphic mineral or gemstone and the colored particles comprise an ionic compound, the colored metal comprises an engineering metal and the colored metal has a surface and the colored particles have a surface density at the surface that is sufficient to give the colored metal a consistent hue to the human eye.

61. A method as claimed in claim 60, wherein the colored particles have a size between 1 and 100 μm.

* * * * *

UNITED STATES PATENT AND TRADEMARK OFFICE

CERTIFICATE OF CORRECTION

PATENT NO. : 8,790,438 B2
APPLICATION NO. : 12/648390
DATED : July 29, 2014
INVENTOR(S) : Millar et al.

It is certified that error appears in the above-identified patent and that said Letters Patent is hereby corrected as shown below:

In the Claims

Claim 56, col. 9, line 10 “forma” should be deleted and --form a-- should be inserted.

Signed and Sealed this
Twenty-eighth Day of October, 2014

Michelle K. Lee

Michelle K. Lee
*Deputy Director of the United States Patent and Trademark Office*